US010301780B2

(12) United States Patent
White et al.

(10) Patent No.: US 10,301,780 B2
(45) Date of Patent: May 28, 2019

(54) SURFACE JOINING SYSTEM AND METHODS

(71) Applicant: Acme Concrete Paving Inc, Spokane, WA (US)

(72) Inventors: Steven White, Valleyford, WA (US); Robert Seghetti, Spokane, WA (US)

(73) Assignee: Acme Concrete Paving Inc, Spokane, WA (US)

( * ) Notice: Subject to any disclaimer, the term of this patent is extended or adjusted under 35 U.S.C. 154(b) by 0 days.

(21) Appl. No.: 14/446,331

(22) Filed: Jul. 29, 2014

(65) Prior Publication Data

US 2016/0032538 A1 Feb. 4, 2016

(51) Int. Cl.

| | |
|---|---|
| ***E01C 11/06*** | (2006.01) |
| ***E01C 11/14*** | (2006.01) |
| ***B28D 1/14*** | (2006.01) |
| ***E01C 23/04*** | (2006.01) |

(52) U.S. Cl.

CPC ..... *E01C 11/06* (2013.01); *B28D 1/14* (2013.01); *E01C 11/14* (2013.01); *E01C 23/04* (2013.01); *E01C 2201/00* (2013.01)

(58) Field of Classification Search

CPC ..... E01C 23/04; E01C 23/0933; E01C 11/06; E01C 11/04; E01C 11/14; E01C 11/02; E01C 11/005; E01C 23/094; E01C 2201/00; B28D 1/14–1/146

USPC ..... 404/61, 62, 63, 87, 88, 89, 75; 299/39.3

See application file for complete search history.

(56) References Cited

U.S. PATENT DOCUMENTS

| | | | | |
|---|---|---|---|---|
| 2,643,555 | A * | 6/1953 | Steibel | B23Q 5/261 173/18 |
| 5,492,431 | A * | 2/1996 | Rasmussen | E01C 23/04 404/75 |
| 2010/0215449 | A1* | 8/2010 | Kern | B23B 39/14 408/1 R |
| 2014/0265526 | A1* | 9/2014 | Knapp | E01C 23/0933 299/39.3 |
| 2015/0153456 | A1* | 6/2015 | Feller | G01S 19/14 342/357.51 |

* cited by examiner

*Primary Examiner* — George S Gray

(74) *Attorney, Agent, or Firm* — Lee & Hayes, P.C.

(57) ABSTRACT

It may be desirable to join two surfaces of a roadway using a dowel bar retrofit. Various embodiments contemplate creating a cavity for a dowel bar using a cutting head to create a cavity with scalloped walls. The system and methods may provide for an improved structural joint.

19 Claims, 18 Drawing Sheets

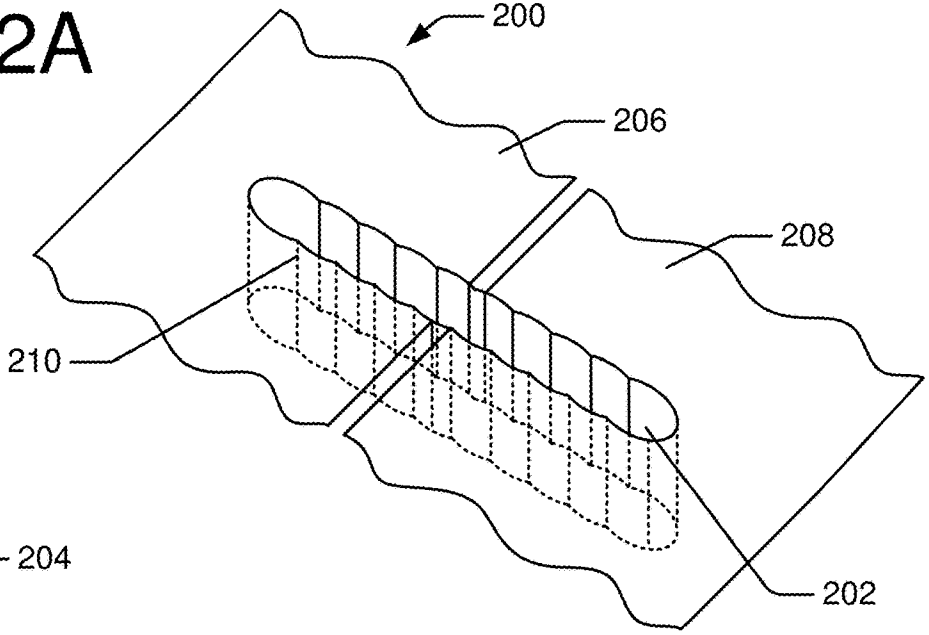
Fig. 2A
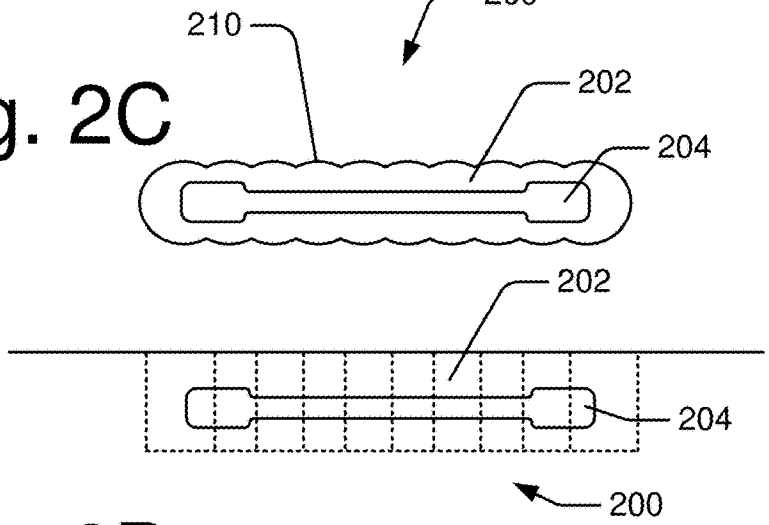
Fig. 2C
Fig. 2B

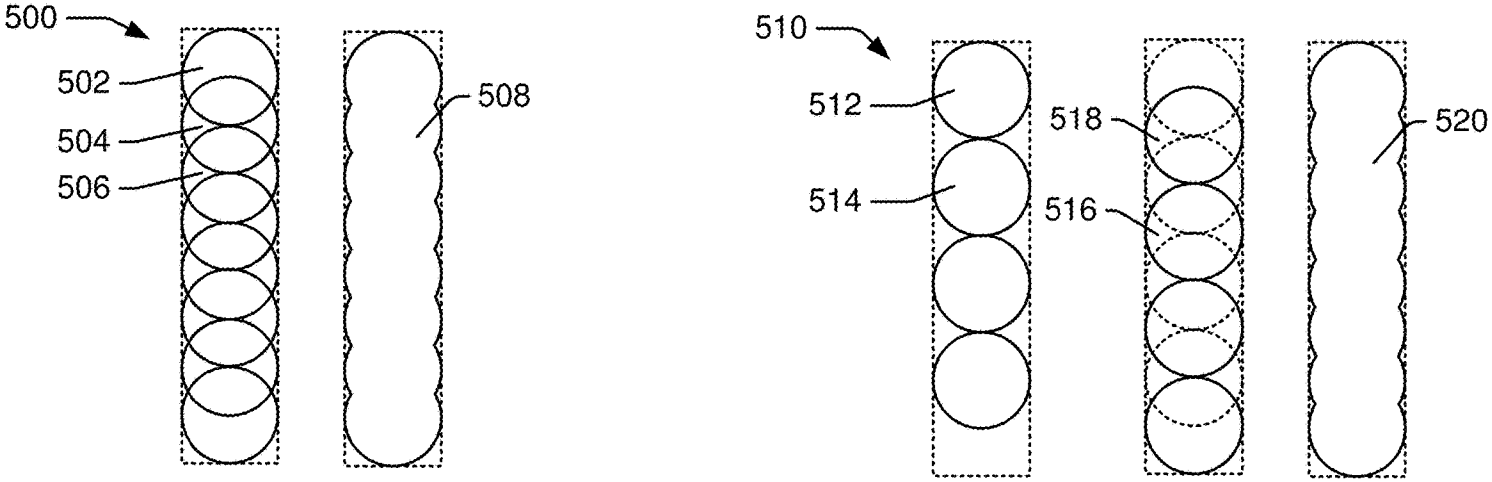
Fig. 5A
Fig. 5B
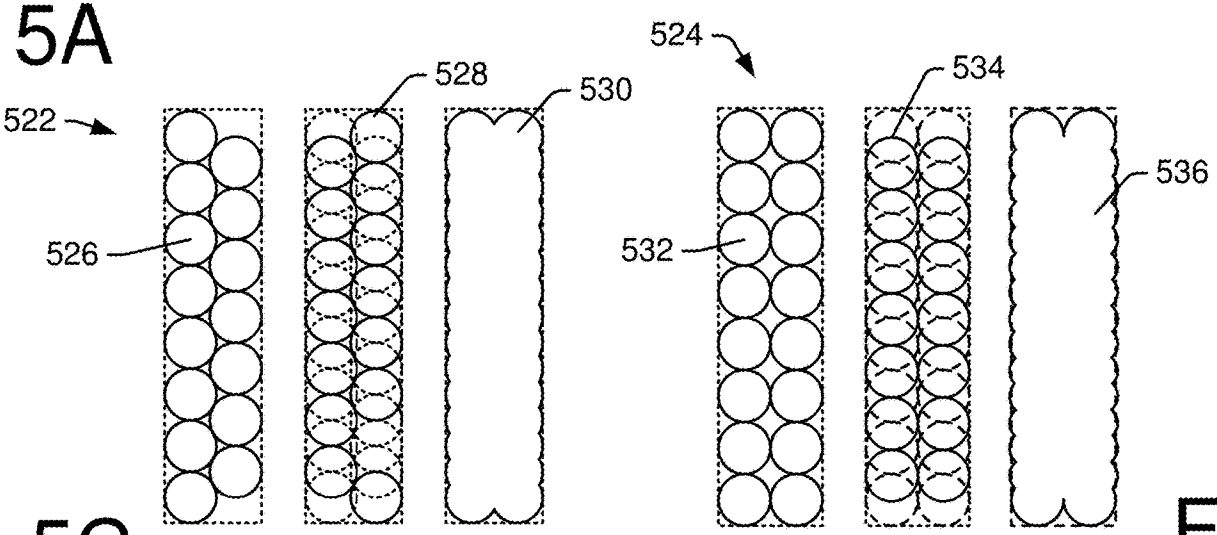
Fig. 5C
Fig. 5D

SURFACE JOINING SYSTEM AND METHODS

BACKGROUND

Some current roadway surfaces are poured in slabs adjacent to each other. Often times it is beneficial to join the adjacent slabs together with dowel bars.

Historically, a dowel bar retrofit included the process of cutting the surface into two slots with a saw using a coolant. Additionally, the material between the two saw cuts had to be removed, often with jackhammers. This requires multiple team members on the jobsite near traffic using heavy tools, often by hand, potentially leading to injury. Therefore, there is a need for an improved method and system for joining two surfaces.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

FIGS. 2A-C show an illustrative example of a joint created by an embodiment of the present disclosure.

FIGS. 5A-D show illustrative patterns of material removal.

DETAILED DESCRIPTION

Overview

This disclosure describes, in part, a system and method for joining two surfaces. Often in joining two surfaces, for example concrete highway surfaces, a dowel bar has been used to span a joint between two surfaces or slabs. If a dowel bar or often a plurality of dowel bars are not present in a joint, a dowel bar retrofit may be used.

The current process for performing a dowel bar retrofit (DBR) on a straight or skewed joint includes cutting the surfaces with parallel cuts of a saw and removing the remaining material with a jackhammer. Often a liquid coolant is used with the saw creating a slurry that must be cleaned up. Additionally, other aspects of the retrofitted joint often include parting compound, caulking, foam core board installation, patching materials, vibration, and cutting of the joint on top of the foam core board.

Figure 1A:
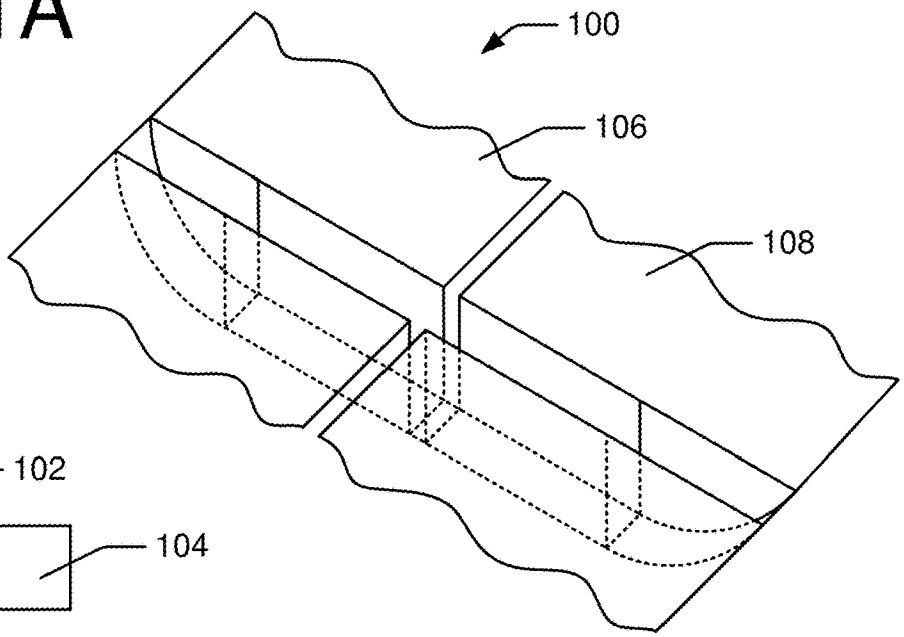
Fig. 1A Prior Art
FIGS. 1A-C show an example of a slot created by the current prior art process.
Figure 1C:
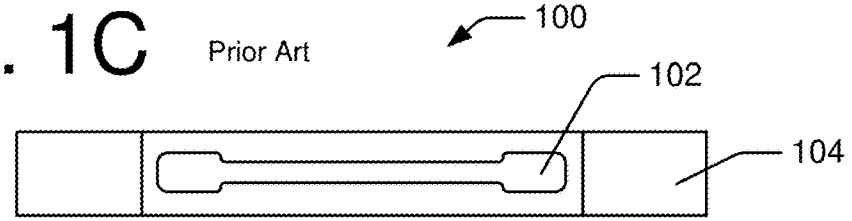
Fig. 1C Prior Art
Figure 1B:
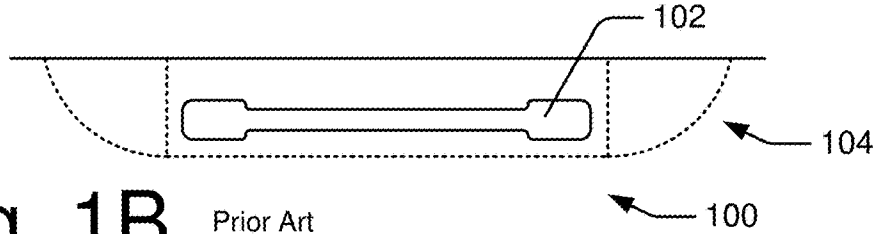
Fig. 1B Prior Art

FIGS. 1A-C show an illustrative example of a slot 100 created by the current process. Step one of the current process is to use a gang saw to cut the slot to mid-depth of slab plus one-half the bar diameter and plus one-half inch. (For example: for a 10-inch deep slab the slot cut shall be 6.25-inches.) The slot on a straight joint shall be 39-inches long, and for skewed joints the slot shall be 44-inches long. The saw cuts are made with a diamond blade mounted on a rotating arbor.

The diamond blades are plunged approximately 2-inches and moved forward the length required to obtain a flat bottom for a minimum of 10.25-inches each side of the transverse joint or random crack. This cut length is based on whether the transverse joint is straight or skewed. At the end of the stroke, the blades are plunged an additional 2-inches and the saw blades are pulled back to the point of beginning. At this point the saw blades are plunged to the final cut depth and moved forward to complete the slot cutting operation. The diamond blades are typically 22-inches to 26-inches in diameter and are cooled with water.

Step two of the current process is to use 30 pound jackhammers, blow pipes hand scraping, shoveling and vacuuming to remove the concrete between the two saw cuts. This process typically involves eight people to prepare the slot for sandblasting. FIGS. 1B-C show two perspectives of the completed slot. For example, FIG. 1B shows an elevation view of the slow with the dowel bar 102 in the slot 100. FIG. 1B also shows the saw cut and cavity 104 that extends beyond the dowel bar 102. FIG. 1C shows view from above looking down into the slot 100. FIG. 1A also shows the location of the slot between the surfaces 106 and 108.

Various embodiments of the present disclosure contemplate creating a opening for the dowel bar without the limitations, dangers, and waste of the current process. For example, a gang saw may be used to cut an edge of the opening. For example, the gang saw may have a width of approximately 3⅜ inches. The cutting of the edges may, in various situations, reduce spalling of the material during the removal of the material. Various embodiments contemplate that the cut may be approximately one or more inches in depth. Various embodiments contemplate a depth of less than one inch, for example, from a light scoring of the surface with the blade to ⅛$^{th}$ of an inch or ½ of an inch. Additionally or alternatively, various embodiments contemplate no cutting by the saw blades at all. Various embodiments contemplate using a wet saw where water or other suitable coolant is used, and or a dry saw where debris from the sawing may be collected during or after the cut by, for example, a vacuum system. Various embodiments contemplate storing the debris and dust collected until it can be disposed of appropriately.

Additionally, the material in between the two edges of the opening created by the saws may be removed with a material removal device. Various embodiments contemplate using a drill to remove the material. For example, a rotohammer may be used. Various embodiments contemplate that the removal device, may be controlled in one, two, or three dimensions, as well as controlling the speed of the removal device. For example, if a rotohammer is used, the location in the various dimensions may be controlled to position the device with respect to the joint and surfaces to be retrofitted. The speed of the rotohammer may also be controlled. This may allow control and adjusting of the removal device to increase the effectiveness and speed of the removal process. For example, certain materials may allow for faster cutting speeds in rotation of the cutting head and/or plunge rate.

Various embodiments contemplate using a rotohammer equipped with a cutting bit, for example, a button bit, substantially sized to an opening. For example, a rotohammer may be equipped with a three-inch button bit. Various embodiments contemplate using this bit to create an opening approximately 2.5 inches wide.

Various embodiments contemplate drilling a first hole with the rotohammer, moving the drill bit up and translating the drill bit approximately ½ of the diameter of the drill bit along a direction of the opening left to be cut, and cutting a second hole. For example, in the case of a three inch drill bit, the rotohammer may be indexed approximately 1.5 inches. Various embodiments contemplate repeating this process until the desired length of the opening is achieved. For example, various embodiments contemplate plunging into the concrete between 10-14 times to create an opening for a dowel bar that is 22 inches long using a three-inch bit. Various embodiments contemplate that at least a portion of a wall of the opening comprises a scalloped surface. The scallops substantially defined by the bit size, and spacing. Various embodiments contemplate that the scalloped surface may provide additional surface area and beneficial orientation for the fill material to engage further strengthening the retrofitted joint. Additionally or alternatively, various embodiments contemplate having a physical and or control stop to control the depth of the opening. Additionally or alternatively, the depth of the opening may be consistent or may have various depth. For example, an alternating depth of approximately ½ inch may provide additional surface area and beneficial orientation for the fill material to engage further strengthening the retrofitted joint.

Various embodiments contemplate possible benefits including, but not limited to, improved safety, reduced size of the slot, a mechanical bond due to surface texture, consistent bottom of slot for dowel bar clearance, and/or, a reduction in labor.

For example, safety is of the upmost importance in any construction operation. The current process places six to ten workers at risk of errant traffic, personal injury such as back injury, carpel tunnel syndrome, and flying debris. Further, errant traffic is a constant concern when you have traffic several feet away from individuals working on the roadway surface and using ear plugs and creating noise that would prevent them from hearing warning signals. The individuals running the jackhammers and blow pipes in this current process have their head down working hard to remove the concrete between the saw cuts. Typically this group of workers is within a short distance of the traveled lane and a vehicle that enters the closed lane can have disastrous consequences to the workers.

Additionally, back injuries are often a result of using the jackhammers, scrapers and shovels for extended periods of time. The jackhammers are often the major culprit of the injuries. The use of the 30 pound hammers for extended periods and the motion involved in removing the concrete between the slots creates some awkward positions for the jackhammer operator. These maneuvers have caused injuries in the past. Due to the constant hammering even with proper use of impact gloves extended periods of jack hammering can cause carpel tunnel syndrome. The process of jack hammering and blowing out the slot can cause flying debris which can impact the traveling public.

However, various embodiments of the new process and processes discussed herein, may be operated by fewer crew members. For example, various embodiments contemplate that the system may be operated by two or fewer operators. Various embodiments contemplate that the operators may be protected by a large piece of equipment that may house the removal operation including, but not limited to, the chipping/drilling, and/or the sawing operations. Various embodiments contemplate that given the size of the equipment, the workers will be protected by the piece of equipment. For example, an errant vehicle would run into equipment as opposed to individuals jack hammering or cleaning slots. Since the crew size may reduced to two or fewer workers, the risk of ten workers being injured by errant vehicle may be reduced to two. Additionally or alternatively, the crew may be reduced to fewer than two members by, for example, controlling the system remotely from an offsite location, a reinforced structure, or a combination thereof. Various embodiments contemplate that the new process will not require any heavy lifting or jackhammers, alleviating the possibility of back injury and carpel tunnel. Furthermore, various embodiments contemplate encapsulating the removal of the concrete from the slots, for example, between the saw cuts and possibly reduce or virtually eliminate the possibility of flying debris from the process when compared to the current process that uses jackhammers.

Additionally, the size of slot may be important factor in the process. For example, as previously discussed the current process requires overcutting the slot in order to achieve the required depth at the end of the dowel bar. The over cut length varies with the depth of concrete, blade size used, and whether the joint is skewed or straight. Often standards limit the location of the center of the saw in the dowel bar placement detail. Since the saws used to create the saw cut typically cut six saw cuts at one time, the length of the slots is even longer on the skewed joints removing even more concrete that would not require removal for the installation of the dowel bar. Often standards dictate that for skewed joints, each slot is individually cut. However, in practice the saw cutting of three slots occurs at one time on a single arbor requiring the slot to be longer than a joint that is perpendicular to centerline.

Various embodiments contemplate that on average 40% less material may be removed, and accordingly may require 40% less patching material to be purchased, mixed, and placed. Ultimately, various embodiments contemplate that there will be a cost savings reducing the cost per dowel bar installed when compared to the current method.

Additionally or alternatively, various embodiments contemplate that the surface texture of the sides of the slot is not 100% polished. The current process requires saw cut full depth leaving a polished surface finish on the sides of the slot. However, various embodiments contemplate that the removal may use small mechanical breaking of the sides of the slot creating a rough texture that may provide a mechanical bond with the patching material. Since the bond to the sides of the slot is often critical in performance of the load transfer of the dowel bar retrofit, various embodiments contemplate a superior joint to the current process.

Additionally or alternatively, various embodiments contemplate that the bottom of the slot may be much more uniform than the current process. The current process uses jackhammers to remove the concrete between the two saw cuts. During the concrete removal process 2-inch spade bits are used to break the concrete away from the bottom of the slot. The break occurs at the weakest point and the bottom can be very rough requiring additional hammering to smooth the bottom. Often the smoothing of the bottom of the slot in this method can break through the slab bottom and potentially eliminate the long term effectiveness of the dowel bar retrofit. However, various embodiments contemplate that a controlled stop which may create a bottom that is even in surface texture giving the often required ½-inch clearance evenly across the bottom of the slot. Various embodiments contemplate that the even surface may allow the patching material to more evenly flow around the dowel bar. Inspection time for the retrofit process may be reduced since the final product may be machine controlled.

Additionally or alternatively, various embodiments contemplate that labor required to perform the work may be dramatically reduced which may ultimately provide a cost savings.

Illustrative Joints

FIGS. 2A-C show an illustrative example of a joint 200 created by an embodiment. For example, FIG. 2A shows a joint 200 with a cavity 202 to receive a dowel bar 204 (shown in FIGS. 2B-C) to join surfaces 206 and 208. Various embodiments contemplate that the cavity 200 may comprise scalloped edges 210.

Figure 3A:
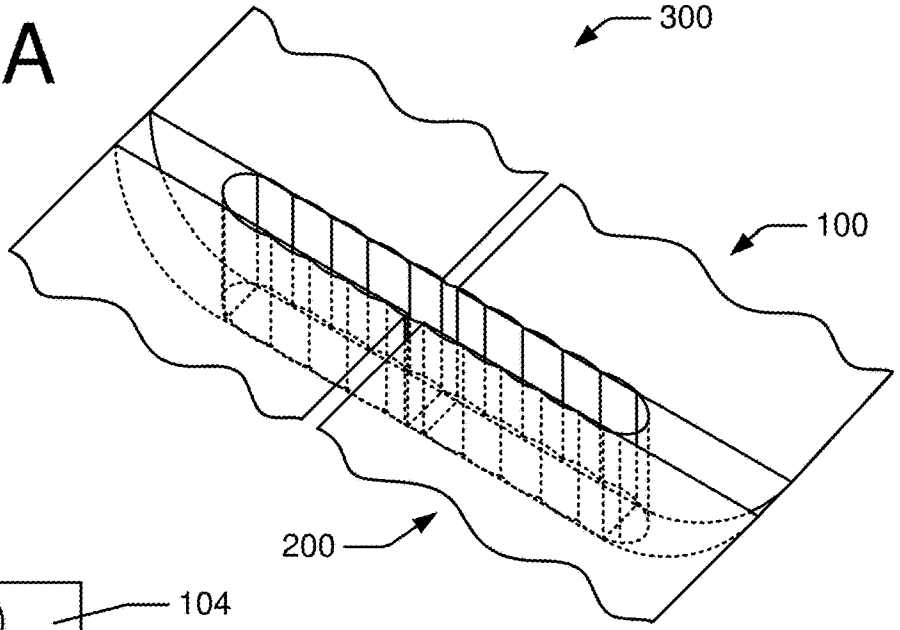
FIGS. 3A-C show an illustrative overlay of the slot shown in FIGS. 1A-C with the cavity illustrated in FIGS. 2A-C.
Figure 3C:
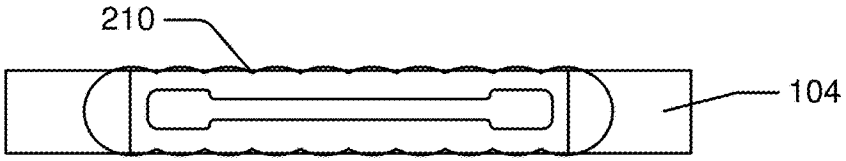
Figure 3B:
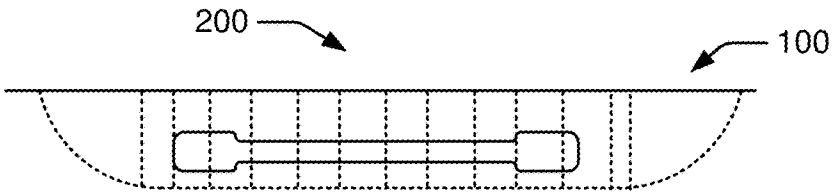

FIGS. 3A-C show an illustrative overlay 300 of the slot shown in FIGS. 1A-C with the cavity illustrated in FIGS. 2A-C. FIGS. 3A-C are for illustrative purposes only and not necessarily limiting to the disclosed features. FIG. 3B shows the saw cut and cavity 104 that extends beyond the dowel bar of the current method and the scalloped edges 210 of the embodiment of FIGS. 2A-C.

Figure 4A:
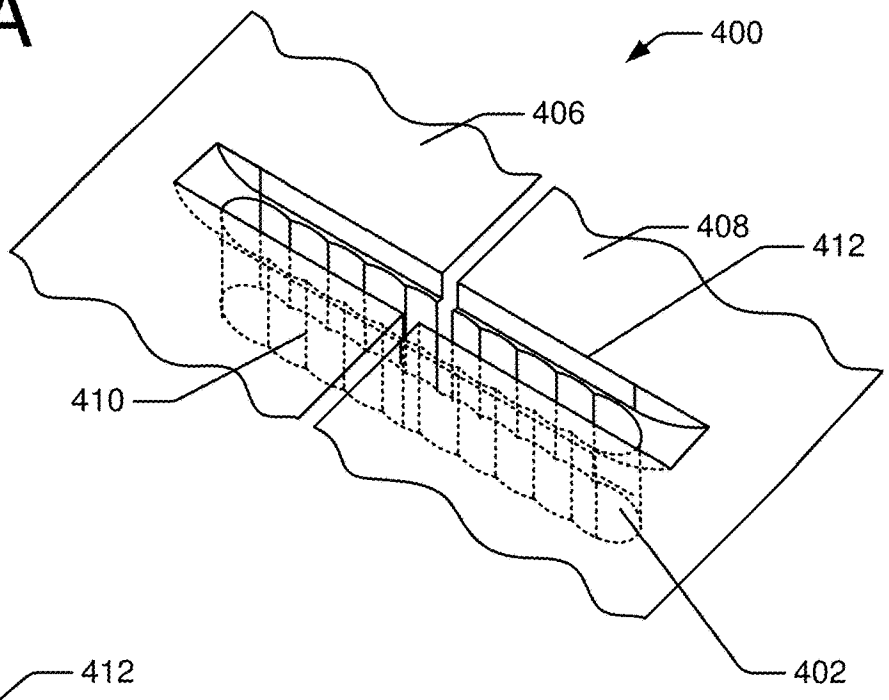
FIGS. 4A-C show an additional embodiment of an illustrative joint.
Figure 4C:
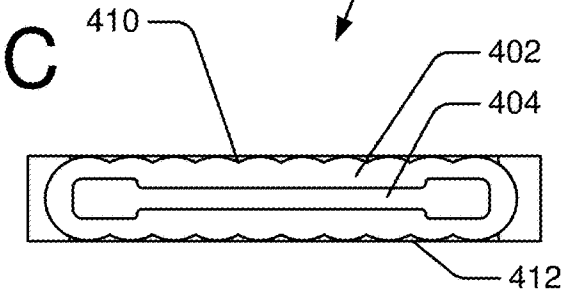
Figure 4B:
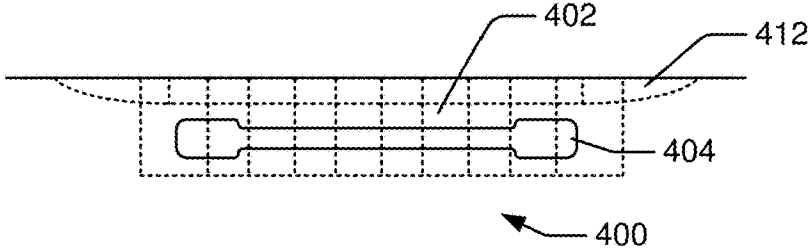

FIGS. 4A-C show an additional embodiment of an illustrative joint. For example, FIG. 4A shows a joint 400 with a cavity 402 to receive a dowel bar 404 (shown in FIGS. 4B-C) to join surfaces 406 and 408. Various embodiments contemplate that the cavity 400 may comprise scalloped edges 410. Additionally, FIGS. 4A-C show an illustrative edge cut 412. As discussed above, an edge cut 412 may provide for a cleaner edge along the surfaces of surfaces 406 and 408. Various embodiments contemplate that a depth of edge cut 412 may extend into the cavity 402 a depth from the top of the surfaces 406 and 408. Various embodiments contemplate that the depth may be between zero and two inches. Various embodiments contemplate a depth of one inch. Various embodiments contemplate a depth of ½ inch. Various embodiments contemplate a depth sufficient to score the surface. Additionally or alternatively, various embodiments contemplate that the edge cut 412 may extend beyond the end the cavity 402 a distance sufficient to achieve a desired depth or it may not extend beyond the cavity at all.

FIGS. 5A-D show illustrative patterns of material removal. For example, FIG. 5A shows an illustrative hole pattern 500 where a first hole 502 may be created and a second hole 504 may be created. The process may be repeated, for example, by creating hole 506, until a cavity 508 is created. Various embodiments contemplate that the second hole 504 may be adjacent to the first hole 502 along a linear direction defining the direction of the cavity 508. Various embodiments contemplate that hole 504 is offset approximately one half of a diameter of either the first hole 502 or the second hole 504. Various embodiments contemplate that the hole 506 is substantially tangential to an edge of the first hole 502.

FIG. 5B shows an illustrative hole pattern 510 where a first hole 512 may be created and a second hole 514 may be created. Various embodiments contemplate that the first hole 512 and the second hole 514 are substantially tangential to each other. FIG. 5B also shows holes 516 and 518 that may be created in a subsequent pass to create cavity 520.

Additionally or alternatively, FIGS. 5C-D show additional hole patterns 522 and 524 respectively. For example, FIG. 5C shows a first set of holes 526 that may be initially created and a second set of holes 528 that may substantially overlap the first set of holes 526 to create cavity 530. FIG. 5D shows a first set of holes 532 that may be initially created and a second set of holes 534 that may substantially overlap the first set of holes 532 to create cavity 536.

Figure 6:
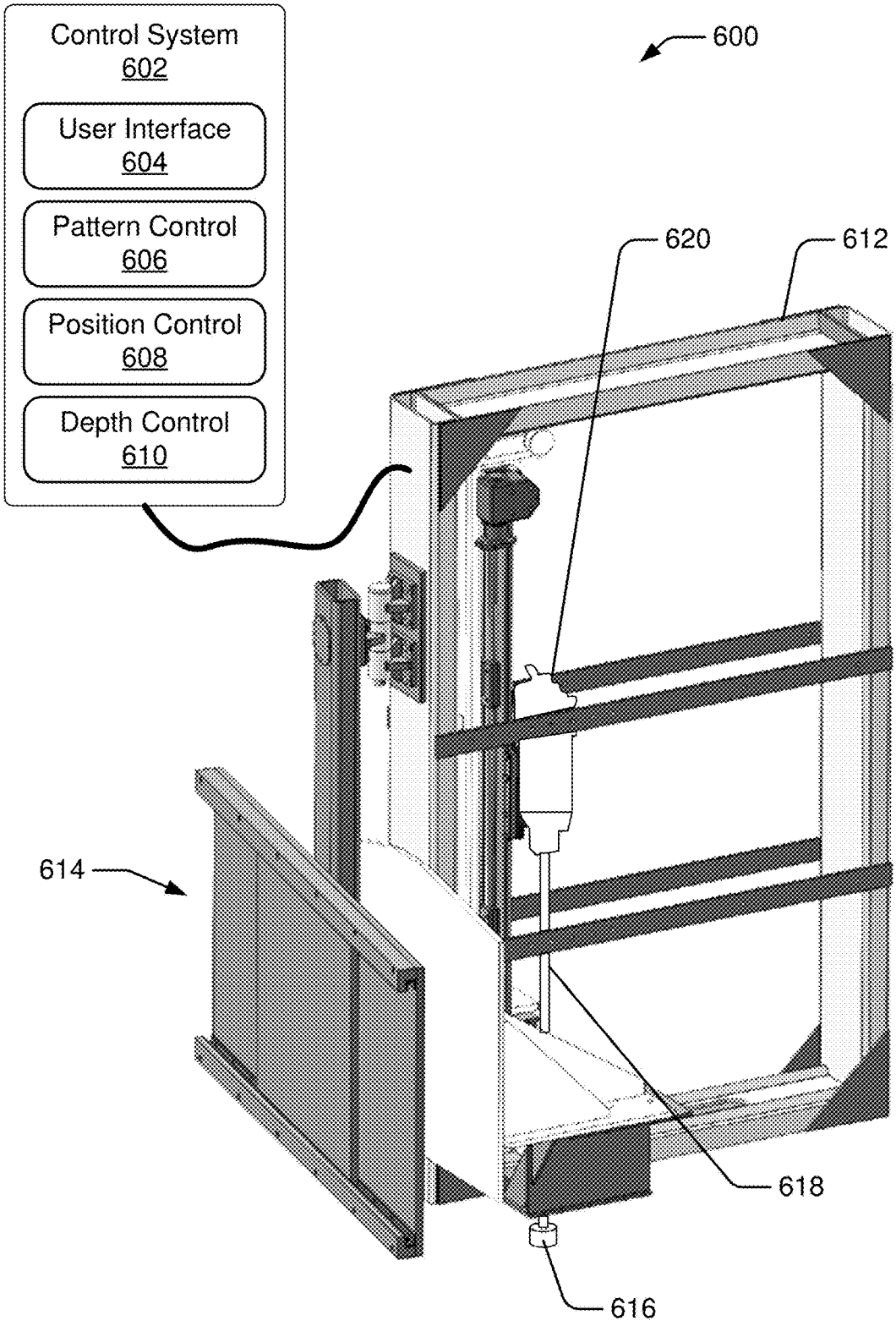
FIG. 6 shows an illustrative system that may implement various features of the present system.

FIG. 6 shows an illustrative system 600 that may create various cavities. For example, system 600 may include a control system 602 that may control the system including, but not limited to location and orientation of the system and any cutting heads with respect to a surface as well as speed of any cutting head. Control system 602 may comprise a user interface 604 allowing a user or operator to change, set, and/or manipulate the system 600. The control system 602 may also include pattern control 606, which may control set and/or variable drill patters for a desired cavity. The control system 602 may include a position control 608 that may control the absolute and/or relative position of the system 600 and/or cutting device to a surface including, but not limited to, and edge of the surface, a crack in the surface, and/or a feature of the surface. The control system 602 may also include depth control 610 that may control the absolute and/or relative depth of a cavity being created. The control system 602 may be localized to the system or may have portions or all located remotely for any cutting surface.

System 600 may also comprise a frame 612 that may be mountable to a vehicle (not shown) through a mounting system 614 that may provide one or more degrees of freedom. The system 600 may also comprise a cutting head 616 moveably coupled to the frame 612 and configured to cut into a surface (not shown). Additionally or alternatively, the cutting head 616 may be coupled to a shaft 618 that may be coupled to a drive 620. The drive 620 may be movably coupled to the frame 612 and may be moved with respect the frame 612 and/or the surface. System 600 may comprise hydraulic systems to move or drive certain elements of the system. For example, a hydraulic system may drive the orientation and position of the cutting head 616 relative to the frame 612 and/or the surface. Additionally or alternatively, an electric or combustion powered system may drive the rotation of the cutting head 616.

Figure 7B:
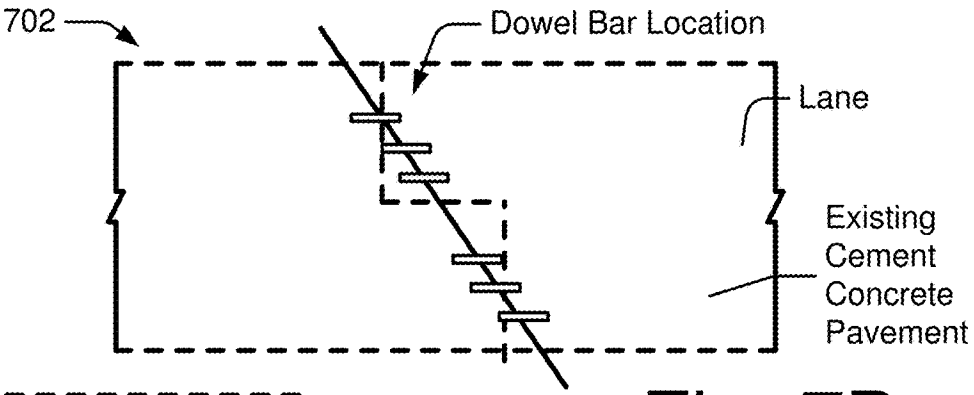
FIGS. 7A-B show illustrative joints that may be created by various embodiments.
Figure 7A:
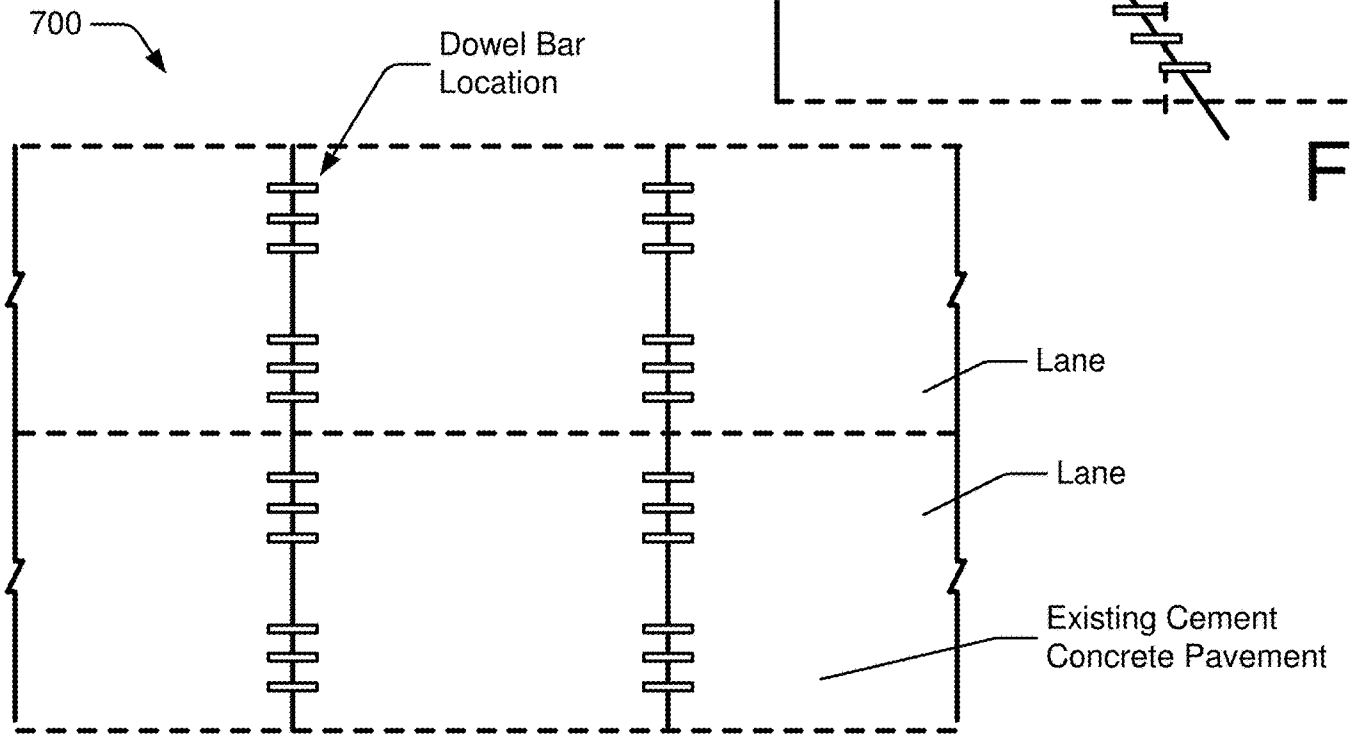

FIGS. 7A-B show illustrative joints that may be created by various embodiments. For example, FIG. 7A shows a straight joint 700 spanning multiple lanes of a roadway. FIG. 7B shows a skew joint 702 across one lane of a road way.

Figure 8B:
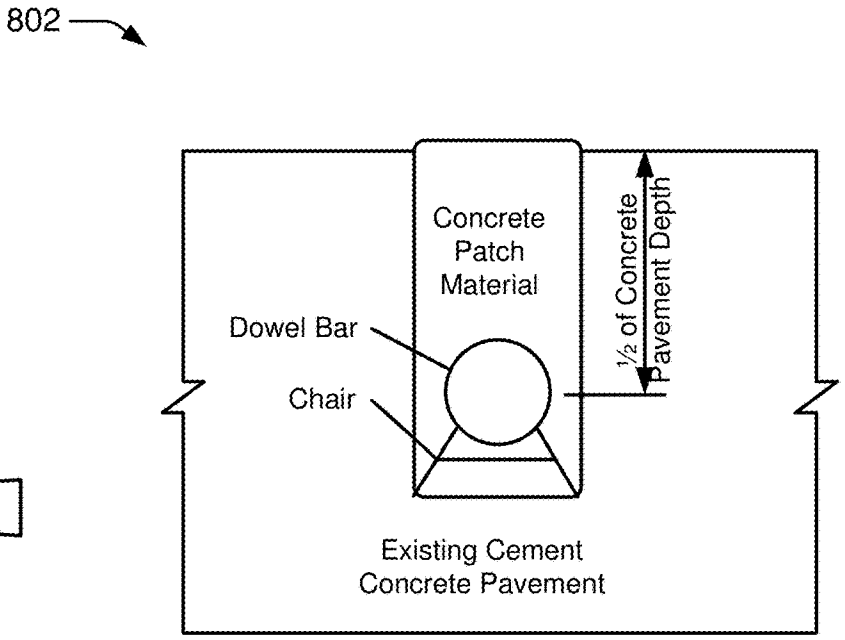
FIGS. 8A-B show illustrative supports for a dowel bar.
Figure 8A:
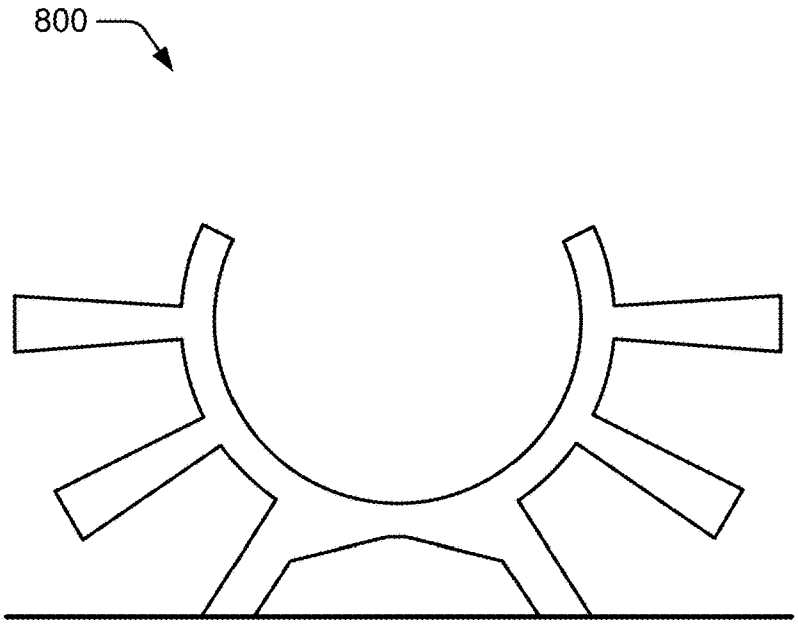

FIGS. 8A-B show illustrative supports for a dowel bar. For example, FIG. 8A shows a chair 800 that may be used to support and orient the dowel bar in the cavity while the cavity is filled in to complete the retrofit. FIG. 8B shows another example of a chair in a cavity supporting a dowel bar.

Illustrative Embodiments

Various embodiments contemplate an apparatus for creating a cavity in a surface where the apparatus may comprise a drill that may be movably coupled to a frame. For example, the drill may be positionable in a vertical, horizontal, and longitudinal position relative to the surface and/or to the frame. The frame may be selectively positionable and securable relative to the surface where the cavity is to be created. The drill may be selectably positionable relative to the surface and configured to create a series of holes creating a cavity in the surface. The series of holes may comprise a pattern of overlapping holes.

Additionally or alternatively, the apparatus may comprise a control system for controlling the position, depth, pattern, cutting speed, or combinations thereof of the drill. Various embodiments contemplate that the surface may comprise concrete, asphalt, cement, a hard surface, or combinations thereof.

Various embodiments contemplate a retrofit connection where the connection may comprise a dowel bar substantially encased in a securing substance where the securing substance may substantially fill a cavity in a surface. Various embodiments contemplate that the cavity may span two plates that create the surface, and the cavity may have substantially vertical walls comprising a scalloped surface. For example, the scalloped surface may be formed using a drill bit.

Additionally or alternatively, the retro fit may comprise one or more dowel chairs supporting the dowel bar prior to the securing substance setting up. Various embodiments contemplate that the surface and plates comprise may comprise concrete, asphalt, cement, a hard surface, or combinations thereof.

Illustrative Methods

Various embodiments contemplate a method for creating a cavity in a surface. For example a method may comprise maintaining a frame in a locked position relative to the surface and cutting a first hole in the surface from a first position with a cutting head. The cutting head may be moved to a second position, where the second position may be substantially adjacent to the first position along a substantially linear path, and the second position may be substantially one half of a diameter of the cutting head from the first position. A second hole may be cut from the second position, where the second hole may substantially overlap the first hole. Additionally, the cutting head may be moved to a third position, where the third position may be substantially adjacent to the second position along the substantially linear path. A third hole may be cut from the third position, where the third hole may substantially overlap the second hole. Additionally or alternatively, subsequent holes may be cut in this fashion until a slot length is reached from the first position substantially along the linear path.

Additionally or alternatively, the first hole and a last hole may be within a threshold distance of the slot length. Additionally or alternatively, the first hole, the second hole, and the third hole may be cut to a depth within a depth threshold of a slot depth.

Additionally or alternatively, prior to cutting of the first hole, rotating blades to make a first cut and second cut may be lowered, where the first and second cut may be substantially parallel to each other and substantially parallel to the linear path. Additionally or alternatively, the first cut and second cut may extend a first distance before the slot length and a second distance beyond the slot length. Additionally or alternatively, the first cut may be substantially tangential to the first hole, the second hole, and third hole. Additionally or alternatively, the first cut and the second cut may be cut to a cut depth, the cut depth being shallower than the slot depth.

Additionally or alternatively, debris from the cutting may be removed with a vacuum system. Additionally or alternatively, the sides of the cavity may be cleaned with an abrasive. For example, the cleaning may comprise sand blasting the sides of the cavity.

Additionally or alternatively, cutting a hole may comprise a first cutting speed and a second cutting speed, where the hole may be cut at the first cutting speed to a first depth, and the hole may be cut to second depth as the second speed. Various embodiments contemplate that the first cutting speed may be slower than the second cutting speed.

Additionally or alternatively, the second depth may be substantially equal to a slot depth. Additionally or alternatively, various embodiments contemplate that the surface may comprise concrete, asphalt, cement, hard surfaces, or combinations thereof.

Figure 9:
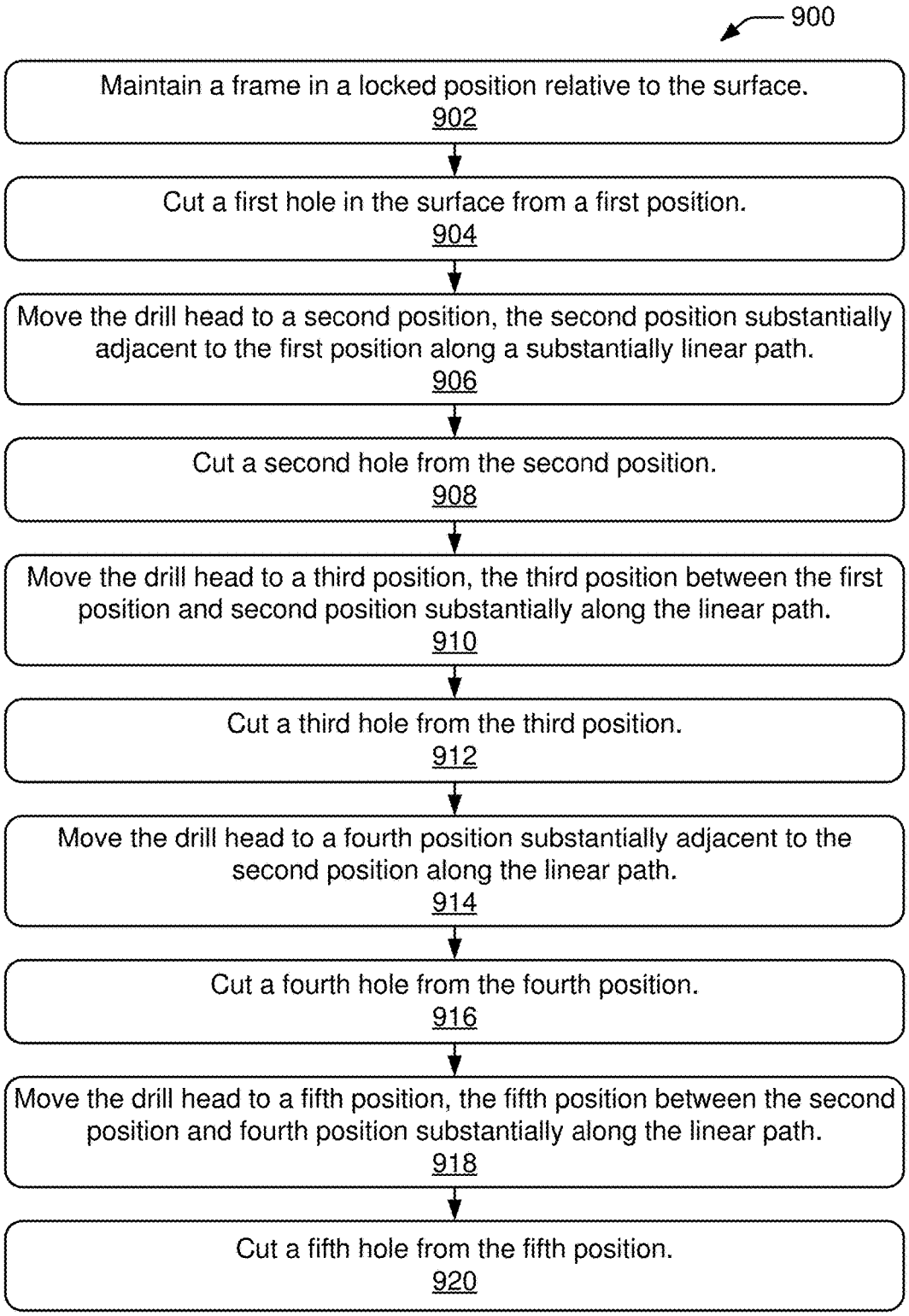
FIGS. 9-10 show illustrative methods for implementing various embodiments.

FIG. 9 shows an illustrative method 900. For example, at 902, a frame is maintained in a locked position relative a surface.

At 904, a first hole is cut at a first position to a first depth with a drill head.

At 906, the drill head may be moved to a second position, where the second position is substantially adjacent to the first position along a substantially linear path.

At 908, a second hole may be cut at the second position to a second depth.

At 910, the drill head may be moved to a third position, the third position may be between the first position and second position substantially along the linear path.

At 912, a third hole may be cut at the third position.

At 914, the drill head may be moved to a fourth position that may be substantially adjacent to the second position along the linear path.

At 916, a fourth hole may be cut at the fourth position.

At 918, the drill head may be moved to a fifth position that may be substantially between the second position and fourth position substantially along the linear path.

At 920, a fifth hole may be cut at the fifth position.

Various embodiments contemplate that the above steps may be substantially repeated to generate a cavity of a desired size. For example, subsequent holes may be cut until a slot or cavity length is reached from the first position substantially along the linear path. Various embodiments contemplate that the first hole and a last hole are within a threshold distance of the slot length. Additionally or alternatively, the first hole, the second hole, and the third hole may be cut to a depth with in a depth threshold of a slot depth.

Additionally or alternatively various embodiments contemplate that, prior to or after the cutting of the first hole or last hole, rotating blades may be lowered to make a first cut and second cut where the first and second cut may be substantially parallel to each other and substantially parallel to the linear path.

Additionally or alternatively, the first cut and second cut may extend a first distance before the slot length and a second distance beyond the slot length. Additionally or alternatively, the first cut may be substantially tangential to the first hole, the second hole, and/or third hole. Additionally or alternatively, the first cut and the second cut may be cut to a cut depth where the cut depth may be shallower than the slot depth.

Additionally or alternatively, debris may be removed from the cutting, for example, with a vacuum system.

Additionally or alternatively, the sides of the cavity may be cleaned with an abrasive. For example, the cleaning may comprise sand blasting the sides of the cavity.

Additionally or alternatively, the cutting of a hole may comprise a first cutting speed and a second cutting speed where the hole may be cut at the first cutting speed to a first depth, and the hole may be cut to second depth as the second speed. Additionally or alternatively, the first cutting speed may be slower than the second cutting speed. Additionally or alternatively, the second depth may be substantially equal to a slot depth.

Additionally or alternatively, the surface comprises concrete, asphalt, cement, a hard surface, or combinations thereof.

Figure 10:
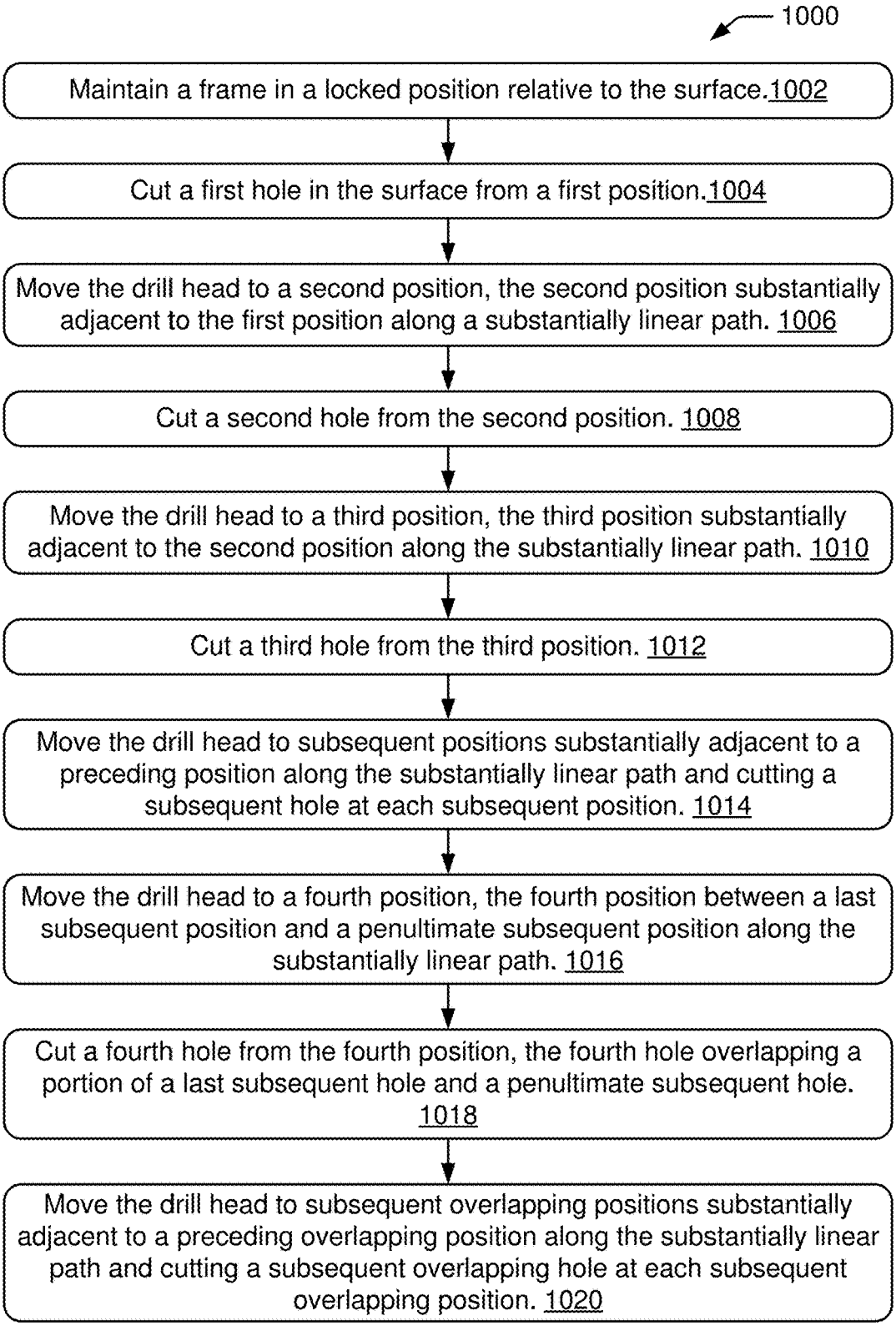

FIG. 10 shows an illustrative method 1000. For example, at 1002, a frame is maintained in a locked position relative a surface.

At 1004, a first hole is cut in the surface by a drill head from a first position.

At 1006, the drill head may be moved to a second position, where the second position may be substantially adjacent to the first position along a substantially linear path.

At 1008, a second hole may be cut from the second position.

At 1010, the drill head may be moved to a third position, where the third position may be substantially adjacent to the second position along the substantially linear path.

At 1012, a third hole may be cut from the third position.

At 1014, the drill head may be moved to subsequent positions substantially adjacent to a preceding position along the substantially linear path and cutting a subsequent hole at each subsequent position.

At 1016, the drill head may be moved to a fourth position, where the fourth position may be between the last subsequent position and the penultimate subsequent position.

At 1018, a fourth hole may be cut from the fourth position where the fourth hole overlaps a portion of the last subsequent hole and a penultimate subsequent hole.

At 1020, the drill head may be moved to subsequent overlapping position substantially adjacent to a preceding overlapping position along the substantially linear path and a subsequent overlapping hole may be cut at each subsequent overlapping position.

Additionally or alternatively, the first hole and the last subsequent position may be within a threshold distance of a slot length. Additionally or alternatively, the first hole, the second hole, the third hole, the subsequent holes, fourth hole, and subsequent overlapping holes may be cut to a depth with in a depth threshold of a slot depth.

Additionally or alternatively, prior to cutting of the first hole or subsequent to cutting the last hole, rotating blades may be lowered to make a first cut and second cut, where the first and second cut may be substantially parallel to each other and may be substantially parallel to the linear path.

Additionally or alternatively, the first cut and second cut may extend a first distance before the slot length and a second distance beyond the slot length. Additionally or alternatively, the first cut may be substantially tangential to the first hole, the second hole, and/or third hole. Additionally or alternatively, wherein the first cut and the second cut may be cut to a cut depth, the cut depth being shallower than the slot depth.

Additionally or alternatively, debris may be removed from the cutting with a vacuum system.

Additionally or alternatively, the sides of the cavity may be cleaned with an abrasive. For example, the cleaning may comprise sand blasting the sides of the cavity.

Additionally or alternatively, the cutting a hole may comprise a first cutting speed and a second cutting speed where the hole may be cut at the first cutting speed to a first depth, and the hole is cut to second depth as the second speed. Additionally or alternatively, the first cutting speed may be slower than the second cutting speed.

Additionally or alternatively, the second depth may be substantially equal to a slot depth.

Additionally or alternatively, the surface may comprise concrete, asphalt, cement, a hard surface, or combinations thereof.

Illustrative Computing Device and Illustrative Operational Environment

Figure 11:
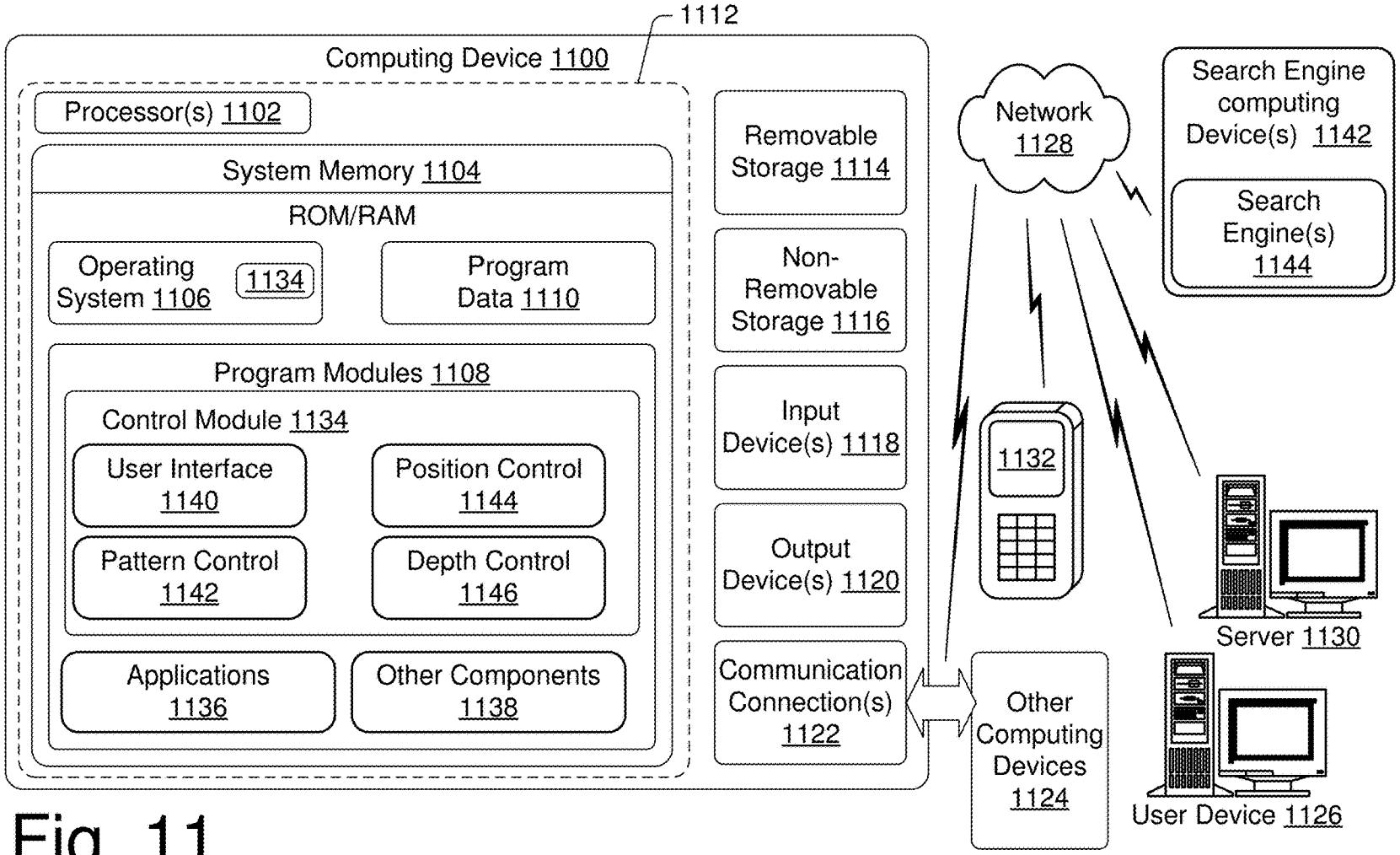
FIG. 11 shows an illustrative operating environment that may be used to control or communicate with various embodiments.
Figure 12:
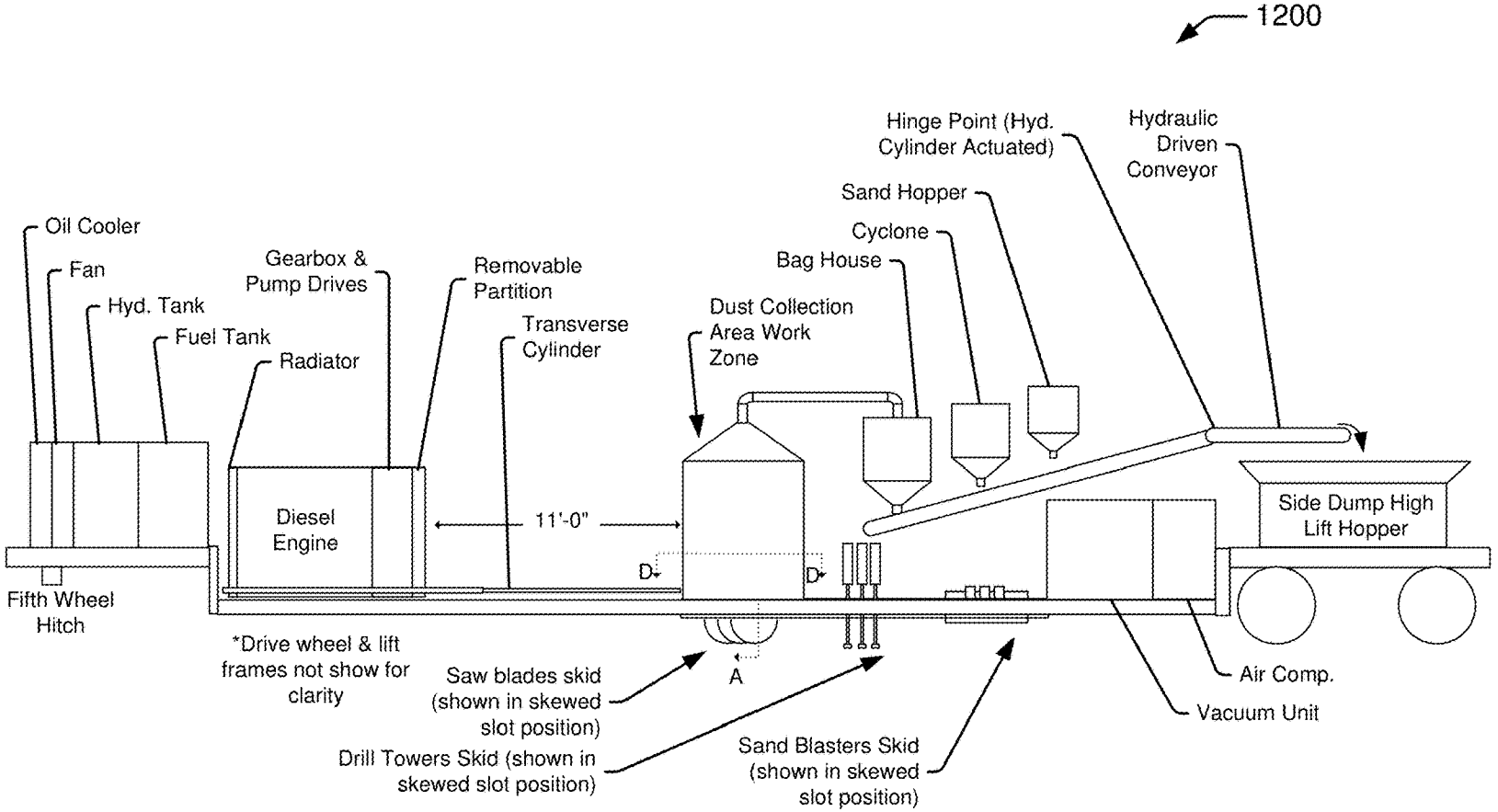
FIGS. 12-18 show an illustrative system for creating cavities in a surface.

FIG. 11 illustrates a representative computing device 1100 that may, but need not necessarily be used to, implement the system and methods described herein, in accordance with various embodiments. The techniques and mechanisms described herein may be implemented by multiple instances of the computing device 1100, as well as by any other computing device, system, and/or environment. The computing device 1100 shown in FIG. 11 is only one example of a computing device and is not intended to suggest any limitation as to the scope of use or functionality of any computing device utilized to perform the processes and/or procedures described above.

In at least one configuration, the computing device 1100 includes at least one processor 1102 and system memory 1104. The processor(s) 1102 may execute one or more modules and/or processes to cause the computing device 1100 to perform a variety of functions. In some embodiments, the processor(s) 1102 may include a central processing unit (CPU), a graphics processing unit (GPU), both CPU and GPU, or other processing units or components known in the art. Additionally, each of the processor(s) 1102 may possess its own local memory, which also may store program modules, program data, and/or one or more operating systems.

Depending on the exact configuration and type of the computing device 1100, the system memory 1104 may be volatile (such as RAM), non-volatile (such as ROM, flash memory, miniature hard drive, memory card, or the like) or some combination thereof. The system memory 1104 may include an operating system 1106, one or more program modules 1108, and may include program data 1110. The operating system 1106 includes a component-based framework 1134 that supports components (including properties and events), objects, inheritance, polymorphism, reflection, and provides an object-oriented component-based application programming interface (API). The computing device 1100 is of a very basic illustrative configuration demarcated by a dashed line 1112. Again, a terminal may have fewer components but may interact with a computing device that may have such a basic configuration.

Program modules 1108 may include, but are not limited to, applications 1136, a control module 1134, a user interface 1140, a pattern control 1142, a position control 1144, a depth control 1146, and/or other components 1138.

The computing device 1100 may have additional features and/or functionality. For example, the computing device 1100 may also include additional data storage devices (removable and/or non-removable) such as, for example, magnetic disks, optical disks, or tape. Such additional storage is illustrated in FIG. 11 by removable storage 1114 and non-removable storage 1116.

The storage devices and any associated computer-readable media may provide storage of computer readable instructions, data structures, program modules, and other data. Computer-readable media includes, at least, two types of computer-readable media, namely computer storage media and communication media.

As used herein, "computer-readable media" includes computer storage media and communication media.

Computer storage media includes volatile and non-volatile, removable and non-removable media implemented in any method or technology for storage of information, such as computer-readable instructions, data structures, program modules, or other data. Computer storage media includes, but is not limited to, random access memory (RAM), read only memory (ROM), electrically erasable programmable ROM (EEPROM), flash memory or other memory technology, compact disk ROM (CD-ROM), digital versatile disks (DVD) or other optical storage, magnetic cassettes, magnetic tape, magnetic disk storage or other magnetic storage devices, or any other medium that can be used to store information for access by a computing device.

In contrast, communication media may embody computer-readable instructions, data structures, program modules, or other data in a modulated data signal, such as a carrier wave. As defined herein, computer storage media does not include communication media.

Moreover, the computer-readable media may include computer-executable instructions that, when executed by the processor(s) 1102, perform various functions and/or operations described herein.

The computing device 1100 may also have input device(s) 1118 such as a keyboard, a mouse, a pen, a voice input device, a touch input device, etc. Output device(s) 1120, such as a display, speakers, a printer, etc. may also be included.

The computing device 1100 may also contain communication connections 1122 that allow the device to communicate with other computing devices 1124, such as over a network. By way of example, and not limitation, communication media and communication connections include wired media such as a wired network or direct-wired connections, and wireless media such as acoustic, radio frequency (RF), infrared, and other wireless media. The communication connections 1122 are some examples of communication media. Communication media may typically be embodied by computer readable instructions, data structures, program modules, etc.

FIG. 11 also shows a schematic diagram of an illustrative operating environment where an illustrative system may operate. For example, various embodiments of the system may operate on the computing device 1100. The computing device 1100 may interact with a user 1126 directly or indirectly. The computing device may be connected to a network 1128. The network device 1128 may provide access to other computing devices 1124 including a server 1130, mobile devices 1132, and/or other connections and/or resources. Connections may be wired or wireless.

The illustrated computing device 1100 is only one example of a suitable device and is not intended to suggest any limitation as to the scope of use or functionality of the various embodiments described. Other well-known computing devices, systems, environments and/or configurations that may be suitable for use with the embodiments include, but are not limited to, personal computers, server computers, hand-held or laptop devices, multiprocessor systems, microprocessor-based systems, set top boxes, game consoles, programmable consumer electronics, network PCs, minicomputers, mainframe computers, distributed computing environments that include any of the above systems or devices, implementations using field programmable gate arrays ("FPGAs") and application specific integrated circuits ("ASICs"), and/or the like.

The implementation and administration of a shared resource computing environment on a single computing device may enable multiple computer users to concurrently collaborate on the same computing task or share in the same computing experience without reliance on networking hardware such as, but not limited to, network interface cards, hubs, routers, servers, bridges, switches, and other components commonly associated with communications over the Internet, as well without reliance on the software applications and protocols for communication over the Internet.

Illustrative Embodiments

Various embodiments contemplate an apparatus for creating multiple cavities in a surface. For example, the apparatus may comprise a plurality of drills movably coupled to a frame where the frame may be selectively positionable and securable relative to the surface. The plurality of drills may be selectably positionable relative to the surface and configured to create a series of holes creating a plurality of cavities. Various embodiments contemplate that plurality of drills may be distributed across the frame. Additionally or alternatively, the series of holes may comprise a pattern of overlapping holes.

Additionally or alternatively, the plurality of cavities may comprise a longitudinal length and wherein the plurality of drills may be distributed along the frame causing the plurality of cavities to be substantially parallel to each other along the longitudinal length. Additionally or alternatively, the plurality of drills may be positionable in a vertical, horizontal, and/or longitudinal position relative to the surface and to the frame.

Additionally or alternatively, the apparatus may comprise a control system for controlling a position, depth, pattern, cutting speed, or combinations thereof of the plurality of drills. Additionally or alternatively, the plurality of drills may comprise three drills. Additionally or alternatively, the plurality of drills comprises six drills. Additionally or alternatively, the plurality of drills may comprise 12 drills.

Additionally or alternatively, the surface may comprise concrete, asphalt, cement, or combinations thereof.

Figure 13:
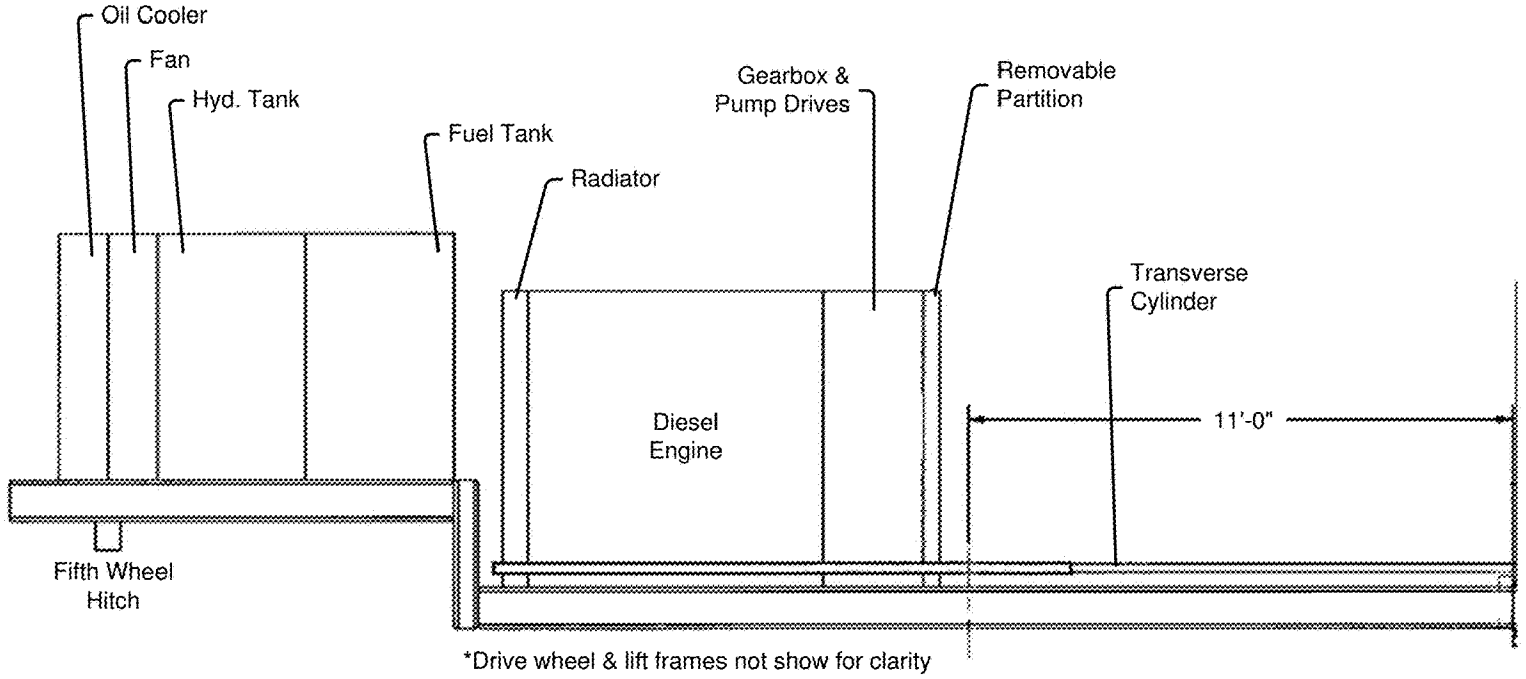

FIGS. 12-18 show an illustrative system 1200 for creating cavities in a surface. FIG. 13 shows a subsection of the system 1200 shown in FIG. 12. For example, the system may have systems that may support the creating of multiple cavities in a surface at a given time. For example, the system 1200 may comprise a platform that may be moveable with respect to a surface or a location of a surface. For example, it might be beneficial to transport the system 1200 over long distances, for example via a trailer. The system 1200 may comprise a hydraulic system that may comprise oil cooling, fans, hydraulic fluid reservoir tanks, fuel tanks, generators, pumps, drives, gears, hydraulic cylinders, among other features and systems.

Figure 14:
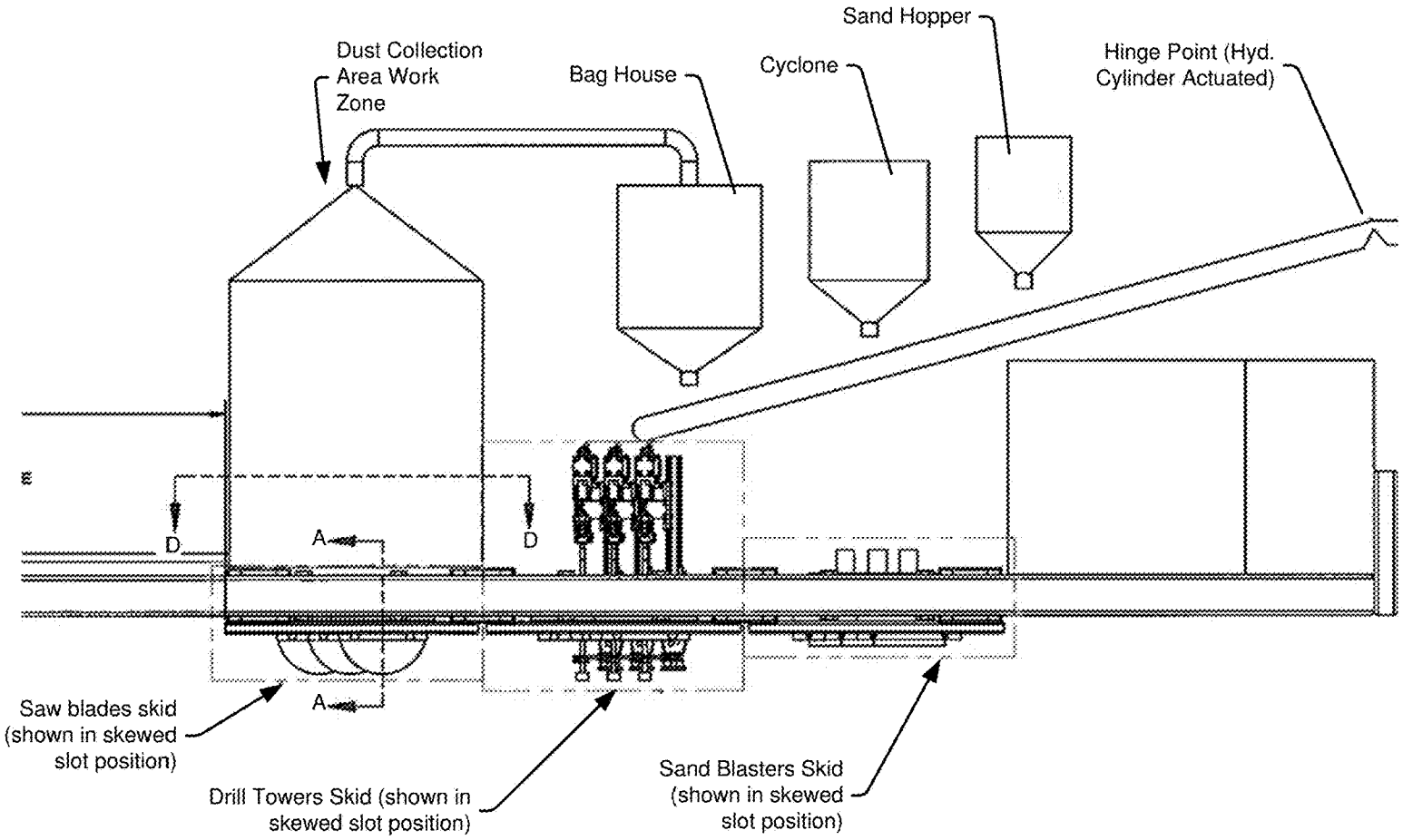

FIG. 14 shows another subsection of system 1200. For example, the system 1200 may have a collection system to harvest debris from the cutting of the surface, including, but not limited to drilling or cutting actions. Additionally, the system may store, separate, dispose of, or transfer out any and/or all debris. System 1200 may also comprise a saw blade assembly that may be positioned to cut a linear joint or a skewed joint. For illustrative purposes only, FIG. 14 shows the saw blades in a skewed joint position. System 1200 may also comprise cutting heads, for example, drills, that may cut a cavity into a surface. Additionally or alternatively, the system 1200 may also have systems to clean and condition a cavity after it has been drilled.

Figure 15:
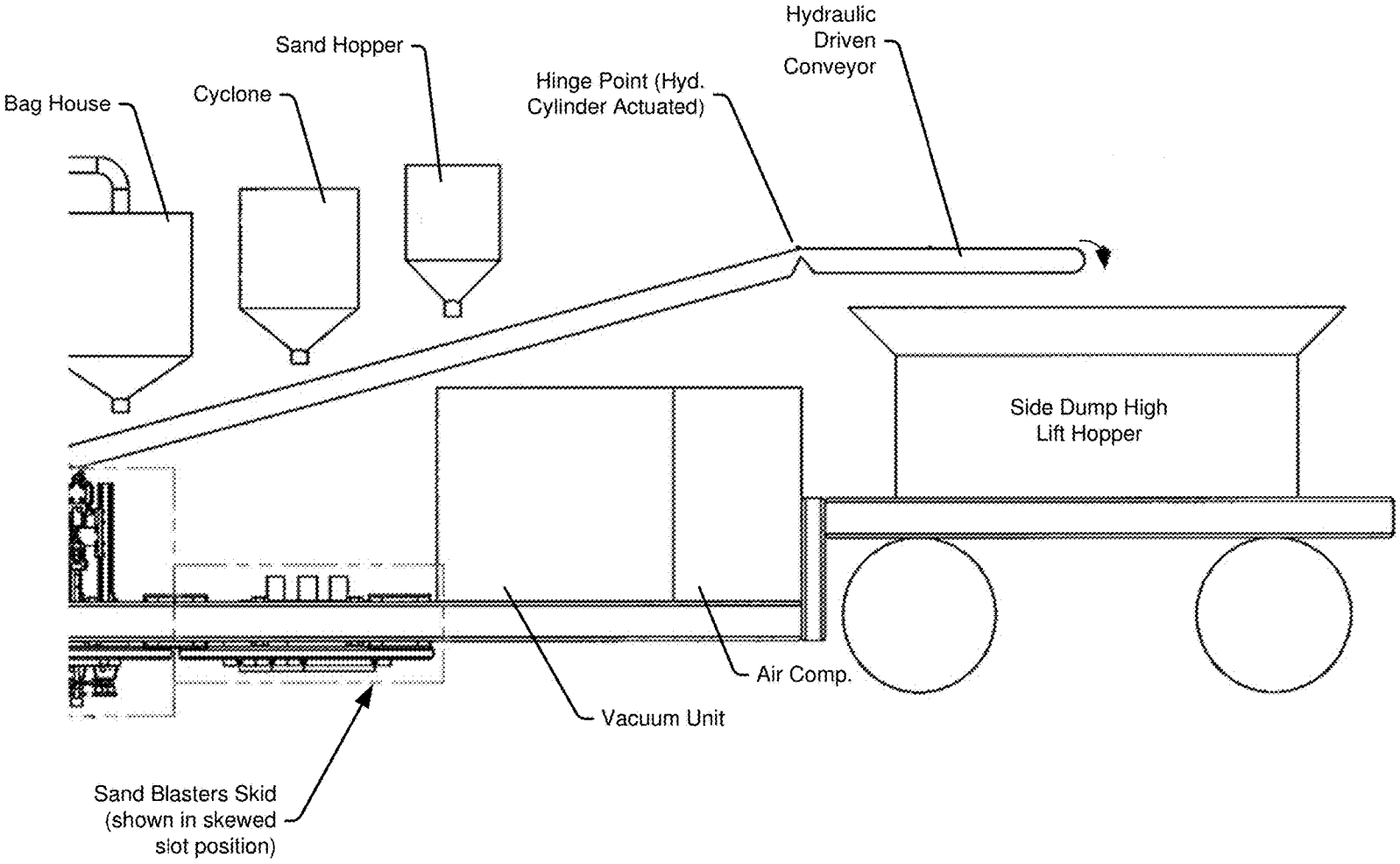

FIG. 15 shows another subsection of system 1200. For example, the debris collected by any of the collection systems may be transported and deposited into a collection center.

Figure 16:
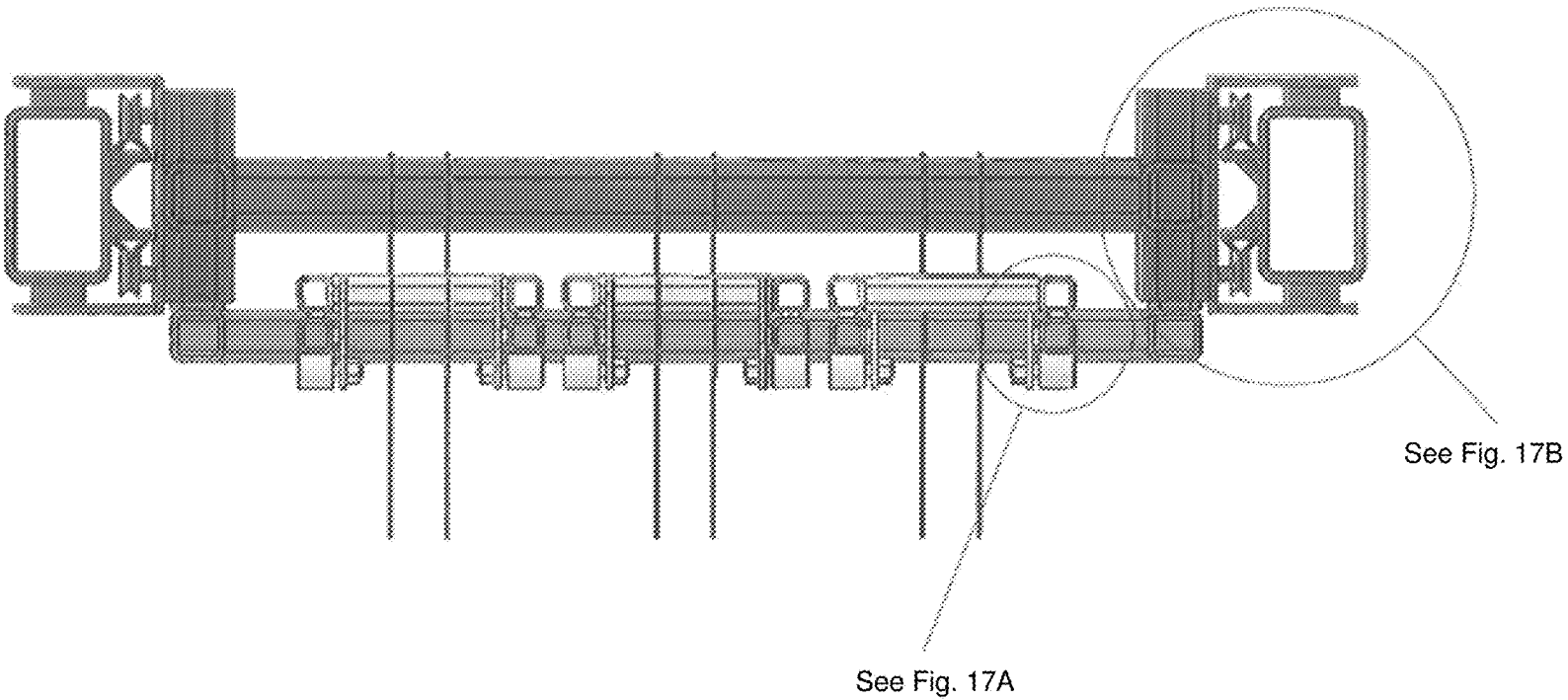

FIG. 16 shows a transverse view of the saw blade assembly discussed with respect to FIG. 14. This embodiment shows six blades along a moveable frame allowing the cutting of the saw blades to be independent of the frame or other cutting features.

Figure 17B:
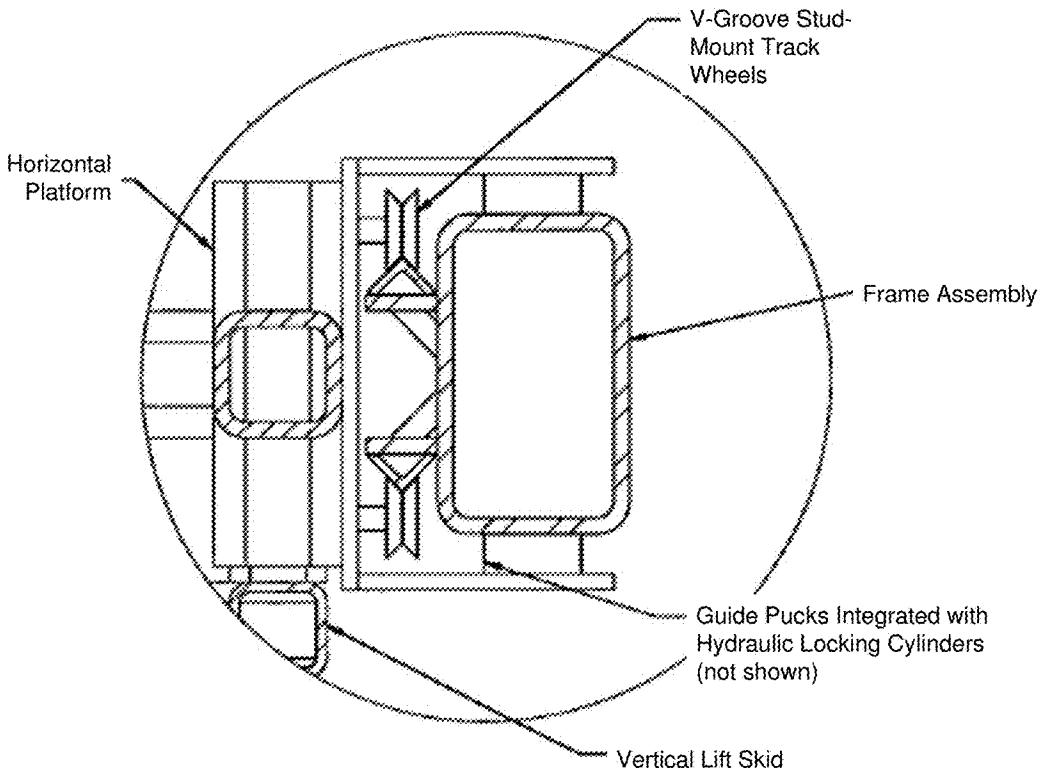
Figure 17A:
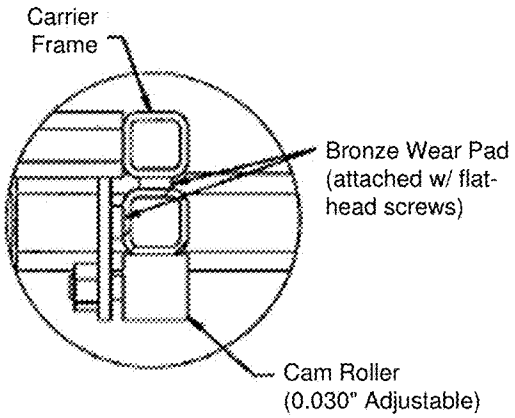

FIGS. 17A-B show additional features of the saw mounting system.

Figure 18:
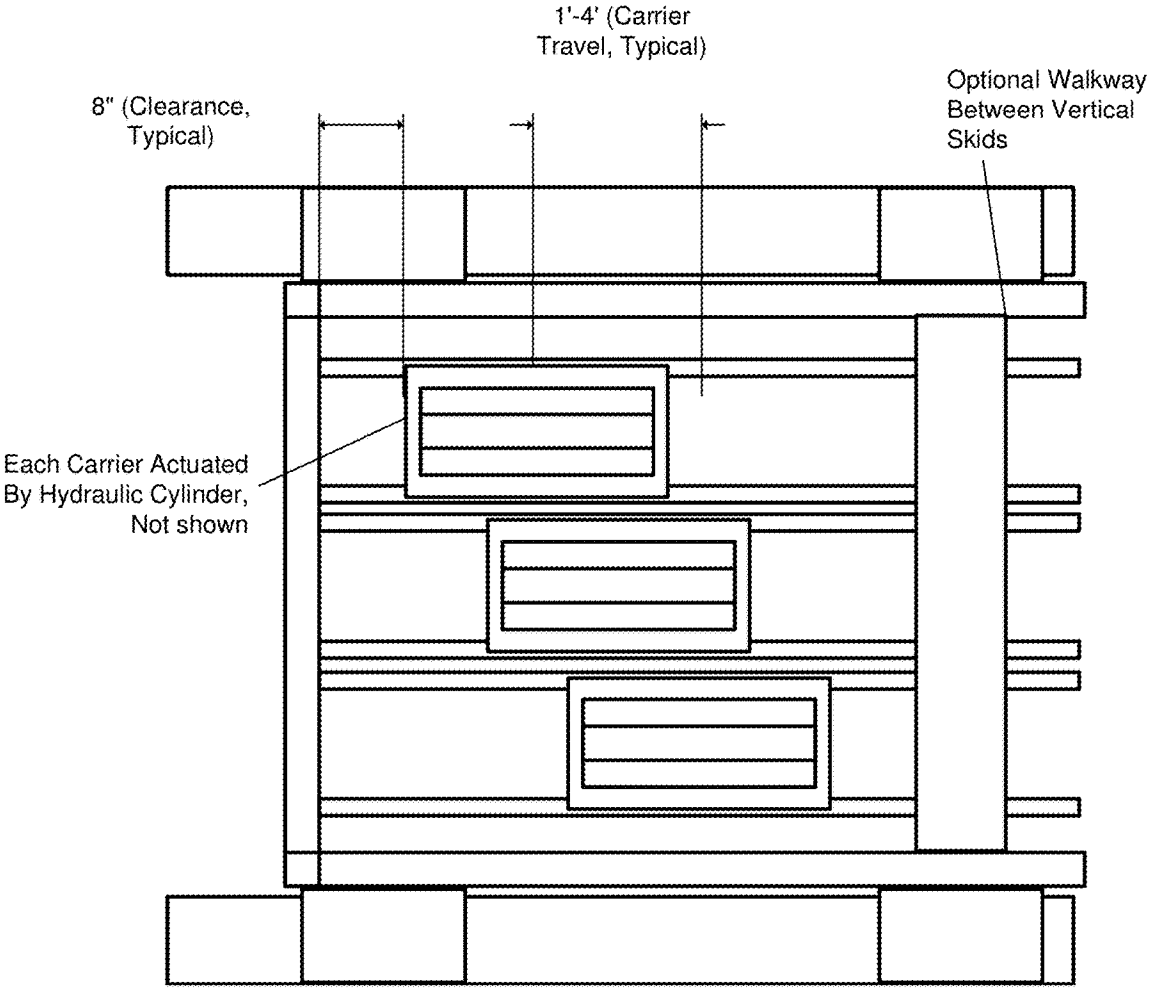

FIG. 18 shows another view of the saw blade assembly discussed with respect to FIGS. 14-17. For example, the saws are shown in a position to cut a skewed joint.

Additionally or alternatively, the system discussed to support the saws may be analogous to the system to support and deploy the cutting heads.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the embodiments. Any portion of one embodiment may be used in combination with any portion of a second embodiment.

What is claimed is:

1. An apparatus for creating a cavity in a surface, the apparatus comprising:

a frame selectively positionable and securable relative to the surface, the frame having a longitudinal axis substantially parallel to the surface;

a drill movably coupled to the frame, the drill selectably positionable relative to the frame and to the surface and configured to create a series of holes creating a cavity, the series of holes comprising a pattern of overlapping holes; and a control system, operably coupled to the drill and operably coupled to actuators controlling a location of the drill relative to the frame and surface, the control system comprising:

one or more processors; and memory storing computer-executable instructions that, when executed by one or more processors, cause the one or more processors to perform operations comprising:

based at least in part on a desired cavity configuration:

determine a series of holes to be drilled by the drill;

send a first command signal to the drill and actuators controlling a location of the drill relative to the frame to cut a first hole in the surface at a first location; and send a second command signal to the drill and actuators controlling the location of the drill relative to the frame such that the drill is moved relative to the frame in a direction parallel to the frame longitudinal axis to cut a second hole in the surface at a second location substantially adjacent to the first location causing the first hole and second hole to partially overlap.

2. The apparatus of claim 1, wherein the drill is positionable in a vertical, horizontal, and longitudinal position relative to the surface and to the frame.

3. The apparatus of claim 1, the control system is configured to control a position, depth, pattern, cutting speed, or combinations thereof of the drill.

4. The apparatus of claim 1, wherein the surface comprises concrete, asphalt, cement, or combinations thereof.

5. The apparatus of claim 1, further comprising:

rotating blades movably coupled to the frame;

the frame selectively positionable and securable relative to the surface;

the rotating blades selectably positionable relative to the surface and configured to create substantially parallel cuts to each other substantially adjacent to the series of holes; and the control system further configured to position the rotating blades relative to the surface, the operations further comprising creating substantially parallel cuts to each other substantially adjacent to the series of holes.

6. The apparatus of claim 5, wherein the apparatus is further configured to create the substantially parallel cuts prior to creating the series of holes.

7. The apparatus of claim 5, wherein the apparatus is further configured to create the substantially parallel cuts to a depth shallower than a depth of the series of holes.

8. The apparatus of claim 5, wherein the apparatus is further configured to create the substantially parallel cuts to extend a first distance before the series of holes and a second distance beyond the series of holes.

9. The apparatus of claim 5, wherein the apparatus is further configured to create the substantially parallel cuts substantially tangential to two or more holes of the series of holes.

10. The apparatus of claim 1, further comprising a vacuum system configured to remove debris from the cavity.

11. The apparatus of claim 1, further comprising an abrasive application system configured to clean sides of the cavity with an abrasive.

12. The apparatus of claim 1, the operations further comprising:

based at least in part on the determined series of holes, the second command signal comprising a command to move the drill from the first location to the second location where the second location causes the second hole in the surface to substantially overlap with the first hole in the surface; and send a third command signal to the drill and actuators controlling the location of the drill relative to the frame to cut a third hole in the surface at a third location, the third location causing the third hole in the surface to substantially overlap with the second hole in the surface, the third location aligned along a substantially linear path relative to the first location and the second location.

13. The apparatus of claim 12, wherein the second location is substantially on half of a diameter of a cutting head of the drill.

14. The apparatus of claim 1, the operations further comprising:

based at least in part on the determined series of holes, send a first cutting command to the drill and actuators controlling the location of the drill relative to the frame and surface to cut a hole of the series of holes to a first depth at a first cutting speed of the drill, and send a second cutting command to cut the hole to a second depth at a second cutting speed, wherein the first cutting speed is slower than the second cutting speed.

15. An apparatus for creating a plurality of cavities in a surface, the apparatus comprising:

a frame selectively positionable and securable relative to the surface;

a first drill, a second drill, and a third drill movably coupled to the frame and distributed across the frame in a transverse direction, the first drill, a second drill, and a third drill configured to drill a respective cavity of the plurality of cavities simultaneously; and a control system coupled to the first drill, the second drill, and the third drill, the control system comprising:

one or more processors;

memory having instructions stored thereon that, when executed by the one or more processors, configure the one or more processors to perform operations comprising:

based at least in part on a desired cavity configuration:

determine a series of holes to be drilled, in a longitudinal direction, by the first drill, the second drill, and the third drill, the longitudinal direction substantially perpendicular to the transverse direction; and send command signals to the first drill, the second drill, the third drill, and actuators controlling a location, relative to the frame, of the first drill, the second drill, and the third drill to simultaneously drill the determined series of holes creating the respective cavities.

16. The apparatus of claim 15, the operations further comprising:

based at least in part on the determined series of holes, the second command signal comprising a command to:

move the drill from the first location to the second location where the second location causes the second hole in the surface to substantially overlap with the first hole in the surface; and send a third command signal to the drill and actuators controlling the location of the drill relative to the frame to cut a third hole in the surface at a third location, the third location causing the third hole in the surface to substantially overlap with the second hole in the surface, the third location aligned along a substantially linear path relative to the first location and the second location.

17. The apparatus of claim 16, wherein the second location is substantially on half of a diameter of a cutting head of the drill.

18. The apparatus of claim 15, the operations further comprising:

based at least in part on the determined series of holes, send a first cutting command to the drill and actuators controlling the location of the drill relative to the frame and surface to cut a hole of the series of holes to a first depth at a first cutting speed of the drill, and send a second cutting command to cut the hole to a second depth at a second cutting speed, the first cutting speed being slower than the second cutting speed.

19. The apparatus of claim 15, further comprising:

rotating blades movably coupled to the frame;

the frame selectively positionable and securable relative to the surface;

the rotating blades selectably positionable relative to the surface and configured to create substantially parallel cuts to each other substantially adjacent to the series of holes; and the control system further configured to position the rotating blades relative to the surface, the operations further comprising creating substantially parallel cuts to each other substantially adjacent to the series of holes.

* * * * *